US006135520A

United States Patent [19]

Miller et al.

[11] Patent Number: 6,135,520

[45] Date of Patent: Oct. 24, 2000

[54] PET WASTE PICK-UP AND DISPOSAL DEVICE

[75] Inventors: Michael T. Miller, Edina; Dana C. Post, Minnetonka, both of Minn.

[73] Assignee: Hound Dog Products, Inc., Edina, Minn.

[21] Appl. No.: 09/373,304

[22] Filed: Aug. 12, 1999

Related U.S. Application Data

[60] Provisional application No. 60/096,419, Aug. 13, 1998.

[51] Int. Cl.[7] ..... A01K 29/00; E01H 1/12

[52] U.S. Cl. ..... 294/1.4; 294/19.1

[58] Field of Search ..... 294/1.1, 1.3–1.5, 294/19.1, 19.2, 50.9, 55, 104; 15/104.8, 257.1–257.4, 257.6, 257.7; 56/400.12; 119/161

[56] References Cited

U.S. PATENT DOCUMENTS

| | | | |
|---|---|---|---|
| 3,431,008 | 3/1969 | Narita | 294/1.4 |
| 4,200,321 | 4/1980 | Workentin | 294/1.4 |
| 4,225,174 | 9/1980 | Hennessy et al. | 294/1.4 |
| 4,368,907 | 1/1983 | Ross | 294/1.4 |
| 4,398,759 | 8/1983 | Manola | 294/1.4 |
| 5,320,393 | 6/1994 | Cortinas | 294/1.4 |
| 5,820,179 | 10/1998 | Tsou | 294/1.4 |

FOREIGN PATENT DOCUMENTS

| | | | |
|---|---|---|---|
| 2604420 | 8/1977 | Germany | 294/1.4 |

*Primary Examiner*—Johnny D. Cherry
*Attorney, Agent, or Firm*—Nikolai, Mersereau & Dietz, P.A.

[57] ABSTRACT

A pet waste disposal device having a handle with a squeeze grip for actuating a sweep arm adjacent the ground for urging objects on the ground into a hoop portion having a bag attached such that when the device is lifted toward the horizontal objects in the hoop portion fall into the bag. The bag is detachable from the hoop portion being secured thereto by a band around the bag and the hoop portion. The hoop portion has a lip such that the band will not slip off the hoop and will secure the bag to the hoop. Optionally the hoop portion is rotatably secured to the device such that objects may be picked up from the side of the handle or in front of the handle. A spring attached to the device opposes the squeeze grip to default the device in the open position with the sweep member away from the hoop. However a pin on the squeeze grip can be engaged by a member on the horizontal handle to lock the sweep member in a position adjacent to the hoop. Teeth on the hoop and sweep arm make it easier to pick up objects on the ground.

12 Claims, 4 Drawing Sheets

PET WASTE PICK-UP AND DISPOSAL DEVICE

CROSS-REFERENCE TO RELATED APPLICATIONS

This application claims priority from U.S. Provisional Patent Application Ser. No. 60/096,419 filed Aug. 13, 1998, which is incorporated herein by reference.

BACKGROUND OF THE INVENTION

I. Field of the Invention

This invention relates generally to a yard and garden tool, and more particularly to a tool for facilitating the pick-up and disposal of pet waste from lawns and the like.

II. Discussion of the Prior Art

A variety of tools have been devised to facilitate removal of animal excrement from lawns. Homeowners with dogs as pets are routinely faced with the need to clear the lawn of excrement so that it is not inadvertently stepped on by persons playing in the yard. A simple shovel or spade may be used to scoop up the dog droppings so that they can be carried to a disposal site. Other tools have been specifically designed for the task and they generally comprise tongs having a cup-like scoop at the lower ends thereof. With the two halves of the scoop spaced apart from one another, they can be positioned about the droppings and then by bringing the tong handles together, the scoops close relative to one another, passing beneath the droppings so that they will be contained within the confines of the scoop. Again, once the droppings are contained within the closed scoop arrangement, they are transported to a disposal site.

The present invention provides a device for conveniently depositing pet excrement in a plastic bag that can be tied shut and deposited in a household trash container for pick-up by a hauler.

SUMMARY OF THE INVENTION

The pet waste pick-up and disposal device of the present invention comprises an elongated handle that allows the pick-up tool to be used from a standing position. Connected to the lower end of the handle is a base member comprising a metal or plastic hoop of a predetermined width dimension and with a generally flat portion for engaging the ground. A sweep member is connected through a linkage arrangement to the lower end of the handle and to an elongated linking member that is contained within the lumen of the tubular handle and leads to a squeeze grip disposed at the upper end of the handle. By grasping the handle and squeezing, the sweep member is made to approach the hoop in a ground-traversing, sweeping motion to move the pet droppings into and through the hoop. A removable plastic bag is designed to fit over the periphery of the hoop such that when the sweep closes relative to the hoop and the tool is swung upward, the droppings fall into the bag which then can be tied off and removed from the periphery of the hoop for disposal. A band secures the bag to the hoop until the bag is removed from the waste pick-up and disposal device. The band is easily secured by arms connected to a spring for providing tension to the band around the hoop.

OBJECTS OF THE INVENTION

It is an object of the invention to pick up and dispose of waste materials without having to stoop over.

It is an object of the invention to dispose of waste in a bag which is easily detached from the device.

Other objects, advantages and novel features of the present invention will become apparent from the following detailed description of the invention when considered in conjunction with the accompanying drawing.

DESCRIPTION OF THE PREFERRED EMBODIMENT

Figure 1:
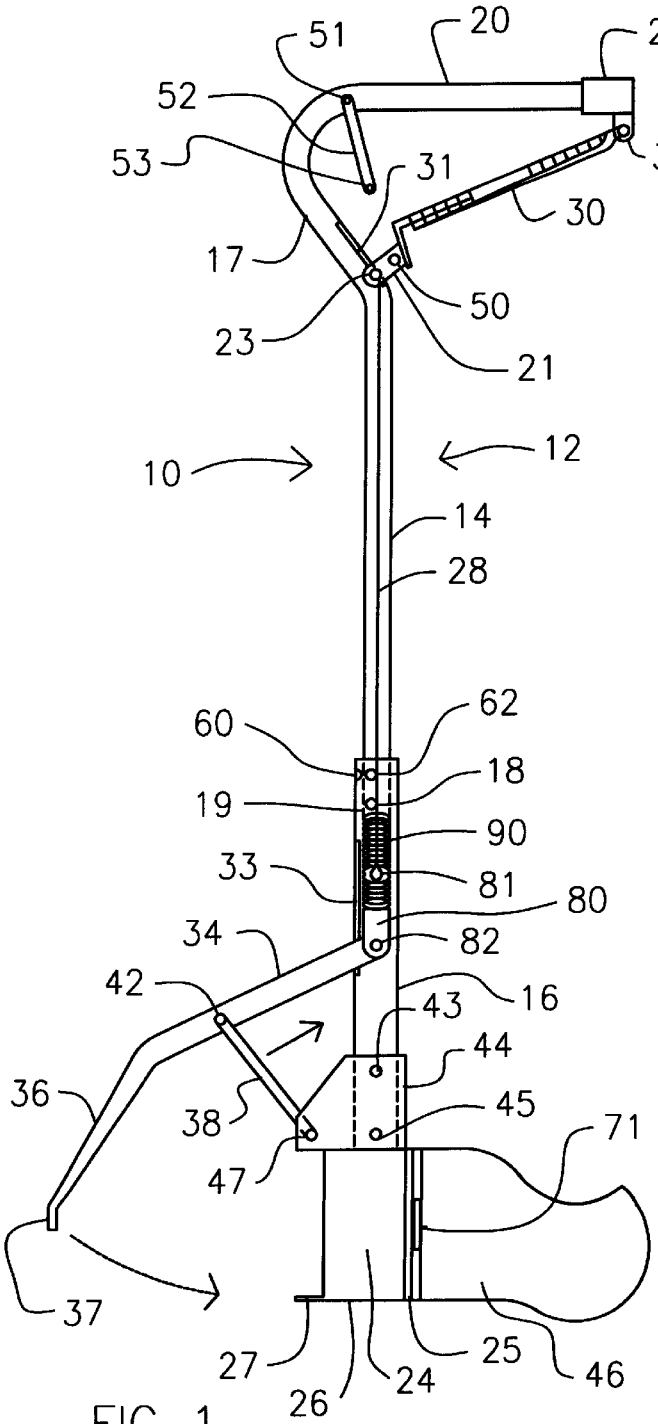
FIG. 1 is a side view of the pet waste pick-up and disposal device of the present invention illustrated with the sweep open.
Figure 2:
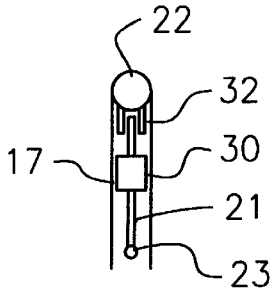
FIG. 2 is a back view of the device of FIG. 1 showing the handle portion of the pet waste pick-up and disposal device.
Figure 3:
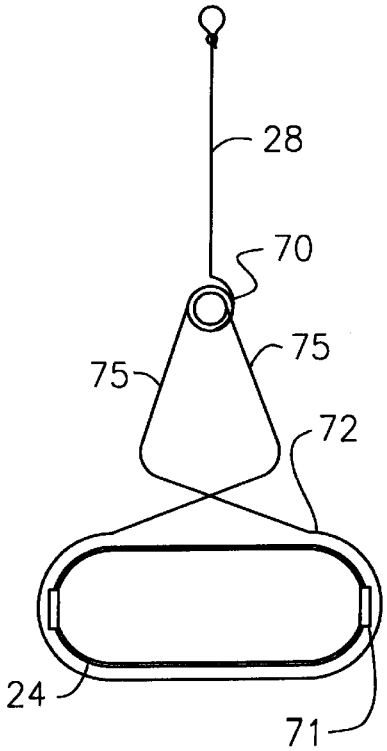
FIG. 3 is a back view of the pet waste pick-up and disposal device showing the bag holding band.
Figure 5:
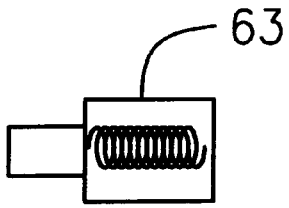
FIG. 5 is a side view of the button spring.
Figure 4:
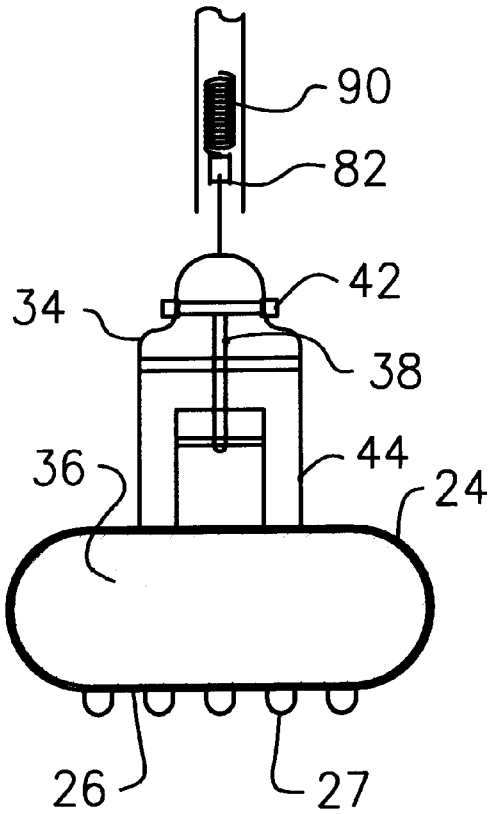
FIG. 4 is a front view of the lower portion of the pet waste pick-up and disposal device.
Figure 6:
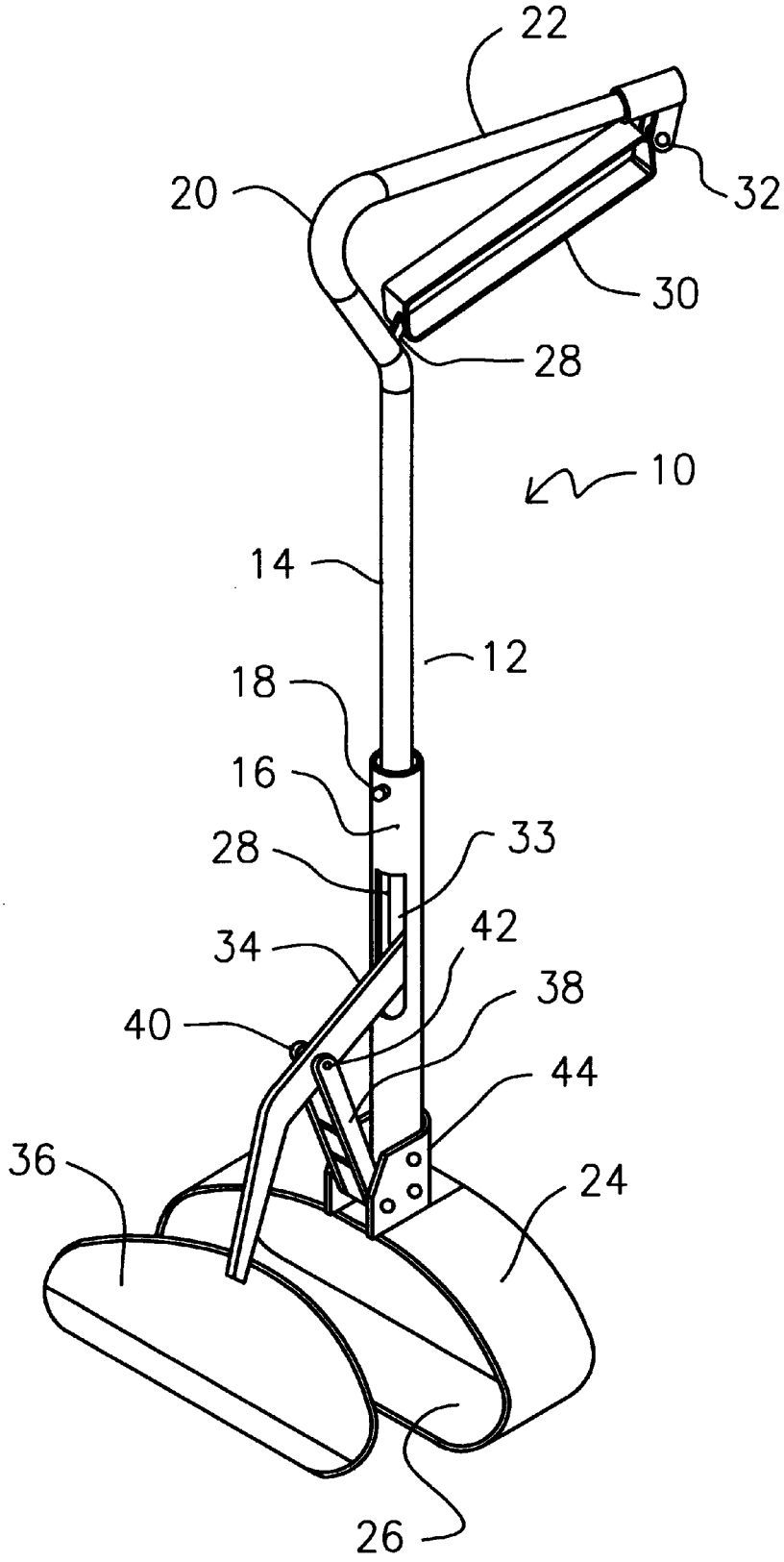
FIG. 6 is a perspective view of an embodiment of the pet waste pick-up and disposal device with the sweep open.
Figure 7:
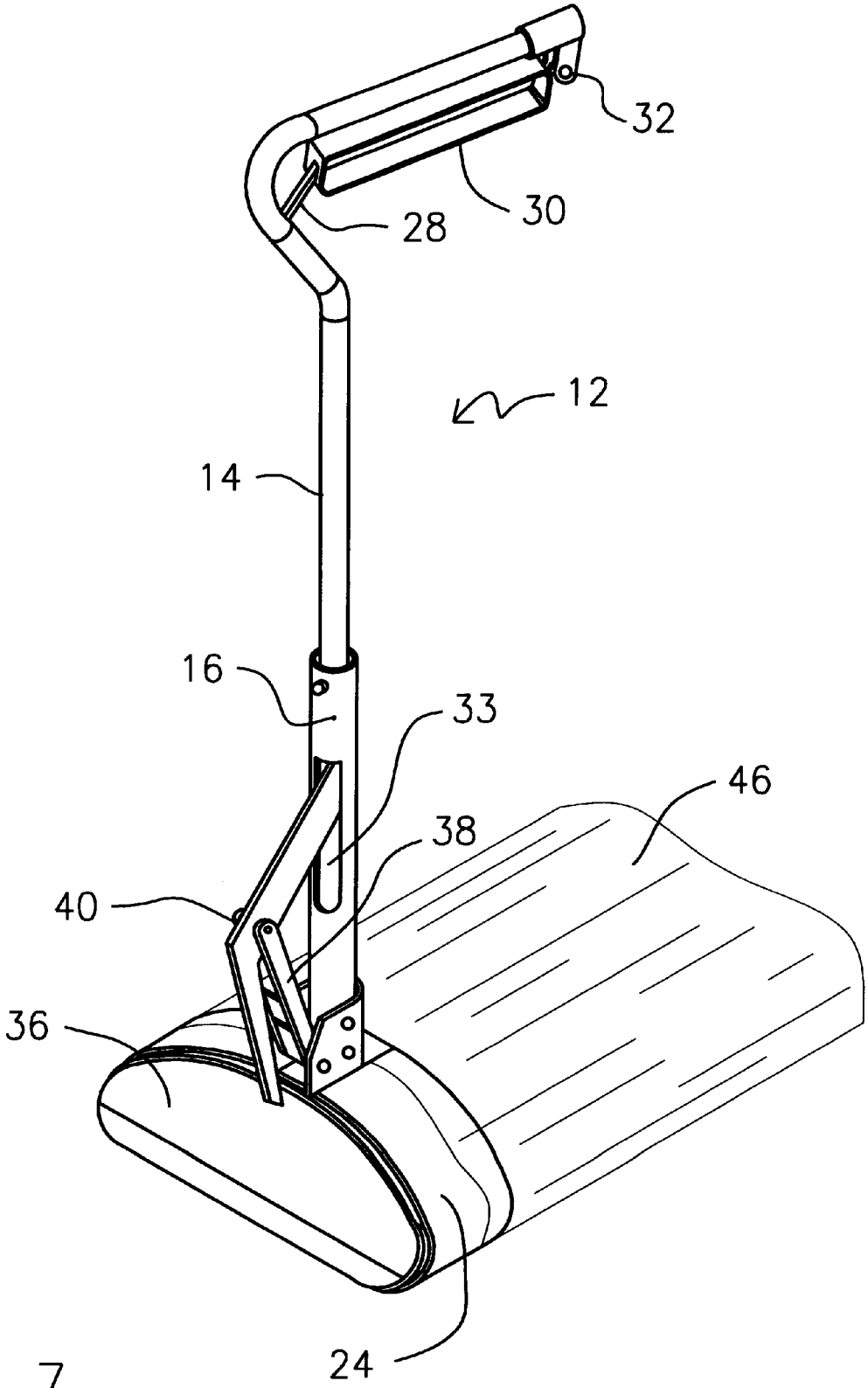
FIG. 7 is a perspective view of an embodiment of the pet waste pick-up and disposal device with the sweep closed.

Referring to the Figures, the pet waste pick-up and disposal device of the present invention is indicated generally by numeral 10 and is seen to include an elongated tubular portion 12, a hoop portion 24, and a sweep member 36 for pushing waste into the hoop portion 24 for disposal in bag 46.

The elongated tube portion 12 has a horizontal handle portion 20, a neck portion 17, an upper vertical portion 14 and a lower vertical portion 16.

The upper vertical portion 14 has a neck portion 17 which is bent forward to provide a slot 31 for access to the lumen of the tubular handle and then curve back to provide the horizontal handle portion 20.

A cap 22 may be fitted over the end of the horizontal handle portion 20 for preventing objects from entering the lumen of the elongated tube portion 12 and for providing a pivot connection point 32 for squeeze grip member 30. Squeeze grip member 30 has an angled portion 21 which is angled such that its tip will ride in the lumen of neck portion 17. The angled portion 21 of squeeze grip 30 has an aperture 23 for providing a connection with a rod or cable 28 which runs the length of the elongated tube portion 12 connecting the squeeze grip member 30 to the sweep member 36.

Affixed to the lower end of the lower vertical portion 16 is a generally D-shaped hoop 24 having a flat base portion 26 for engaging the ground. The hoop 24 is of a predetermined width dimension, sufficient to permit a bag 46 to surround the hoop 24 and be supported thereby at its neck 25.

The hoop 24 has a top portion 44 for engaging the bottom of the bottom portion of lower vertical portion 16. Rivets 43 and 45 or other fasteners may be used to connect lower vertical portion 16 to the hoop 24.

The opposite end of the connecting cable or rod 28 is connected to connection member 80 having a top portion 81 for connection to rod or cable 28 and a bottom portion 82 for pivotally connecting it to one end of an angle arm 34. There is a slot 33 in the base of the bottom portion of lower vertical portion 16 for the angle arm 34 to pass through. The opposite end of the angle arm 34 is fixedly attached to a sweep member 36 which is in the form of a flat plate that is generally D-shaped to conform to the shape of the hoop 24. A linkage arm 38 is pivotably connected at pivot points 42 and 47 to the top portion 44 of the hoop such that when the squeeze grip member 30 is urged upward toward the horizontal handle portion 20, cable or rod 28 pulls up on angle arm 34 moving linkage arm 38 toward a vertical position parallel with the elongated tube portion 12 and drawing sweep member 36 toward hoop 24 such that any objects such as waste material are swept into the interior of hoop 24.

The upper vertical tube portion 14 and the lower vertical tube portion 16 are connected by a rivet 18 or other fastener passing through the lower vertical tube portion 16 and the upper vertical tube portion 14. The upper vertical tube portion may have a slot 19 in which the rivet or other fastener passes through. The slot 19 allows rotation of the upper vertical member 14 relative to the lower vertical tube portion 16. Apertures 60 and 62 in the lower vertical tube portion 16 are preferably rotated 90 degrees relative to each other for allowing rotation of the upper vertical tube portion 14 relative to the lower vertical tube portion 16. A spring loaded button 63 inside of upper vertical tube portion 14 is used to lock the upper vertical tube portion 14 in position relative to the lower vertical tube portion 16 when the button portion of the spring loaded button extends through aperture 60 or 62. By pressing the spring loaded button 63 radially toward the axis of elongated tubular portion 12 the button 63 is disengaged from aperture 60 or 62 and the upper vertical tube portion 14 may be rotated relative to the lower vertical tube portion 16.

Connection member 80 preferably has a spring 90 extending inside of the lower vertical tube portion 16 between the connection member 80 and the base of the upper tube portion 14 such that the spring is compressed when squeeze grip member 30 is pulled toward horizontal handle portion 20 thus returning the sweep member 36 to the open position when squeeze grip member 30 is released.

A pin 50 on the squeeze grip member angled portion 21 in conjunction with a rubber member 52 with aperture 53 attached to the horizontal handle portion 20 by rivet or fastener 51 can be used to engage pin 50 in aperture 53 to keep the sweep member 36 in the closed position against the force of the spring 90 for ease of storage of the pet waste pick-up and disposal device 10 or until the waste collected in hoop 24 is transferred to bag 46 by lifting the waste pick-up and disposal device 10 such that the waste collected falls into the bag 46.

Hoop 24 may be equipped with a neck 25 having one or more lips 71 on the perimeter of the hoop 24 to engage the bag 46 and with the aid of a band 72 disposed between the lip 71 and the center of the hoop 24 the bag 46 may be secured to the hoop until the waste material is collected. Spring 70 may be used to provide tension on the band 72 while it is desired to engage the bag 46 and spring 70 may be compressed on its arms 75 to easily disengage the band 72 from the bag 46.

Optionally teeth 37 on the sweeper member 36 and teeth 27 on hoop 24 will make it easier to scoop up waste material or other objects which the user wishes to collect.

Alternatively one tube may be used for the elongated tube portion 12 instead of an upper vertical tube portion 14 and a lower vertical tube portion 16 which would eliminate the ability of the hoop 24 to be pivoted with respect to the horizontal handle portion 20. In this embodiment spring 90 would be engaged by a rivet 18 or other device to limit the springs 90 movement within the elongated tube portion 12.

The tool may readily be cleaned by simply hosing it off with water.

The fact that the device can be used from a standing position using only one hand is an added benefit.

In addition to being used for picking up pet droppings, the device of the present invention also works well for picking up such things as pine cones, acorns, other lawn debris, or objects laying on the ground. Obviously , many modifications and variations of the present invention are possible in light of the above teachings. It is therefore to be understood that, within the scope of the appended claims, the invention may be practiced otherwise than as specifically described.

What is claimed is:

1. A device for picking up objects from the ground comprising:

a tube having a horizontal handle portion, a vertical portion and a neck portion therebetween, the neck portion having a slot therein, and a base of the vertical portion having a slot therein, the handle portion having a squeeze grip pivotally connected to an end of the handle portion and extending into the slot of the neck portion of the tube, a cable inside the vertical portion of the tube and connected to the squeeze grip, a sweep member pivotally connected to a lower portion of the vertical tube portion, extending through the slot in the base of the vertical tube portion and attached to the cable, a hoop portion attached to the base of the vertical tube portion proximate the sweep member, such that the sweep member pivots toward the hoop portion and pushes objects in to the hoop portion when the squeeze grip is pulled toward the horizontal handle portion.

2. A device for picking up objects from the ground as in claim 1 having, a bag attached to the hoop portion opposite the sweep member such that objects in the hoop portion will drop into the bag when the vertical tube portion is raised toward a horizontal position relative to the ground.

3. A device for picking up objects from the ground as in claim 2 wherein, a band secures the bag to the hoop portion.

4. A device for picking up objects from the ground as in claim 3 wherein, a spring holds the band in place, such that the bag is held to the hoop portion and the spring provides for an easy release of the bag.

5. A device for picking up objects from the ground as in claim 4 wherein, a lip on the hoop portion holds the bag in place in conjunction with the band.

6. A device for picking up objects from the ground as in claim 1 wherein, teeth on the hoop portion and teeth on the sweep member engage the object to be picked up such that it is easier to pick up the object.

7. A device for picking up objects from the ground as in claim 6 wherein, the vertical tube portion having an upper vertical tube portion and a lower vertical tube portion, the lower vertical tube portion rotatably attached to the upper vertical portion such that the hoop portion can be rotated with respect to the handle portion to face in a different direction for picking up objects to one side of the handle portion.

8. A device for picking up objects from the ground as in claim 1 wherein, a spring inside the tube vertical portion is attached at one end to the sweep member and is secured within the tube at the other end such that the spring is compressed when the sweep member is drawn by the cable toward the hoop portion such that the sweep member will be returned to a position away from the hoop portion when the squeeze grip is released.

9. A device for picking up objects from the ground as in claim 8 wherein, the vertical tube portion having an upper vertical tube portion and a lower vertical tube portion, the lower vertical tube portion rotatably attached to the upper vertical portion such that the hoop portion can be rotated with respect to the handle portion to face in a different direction for picking up objects to one side of the handle portion.

10. A device for picking up objects from the ground as in claim 9 wherein, a pin attached to the squeeze grip, and an attachment to the horizontal handle portion having an aperture to engage the pin and lock the squeeze grip in a position adjacent the horizontal handle portion such that the sweep member is locked in a position adjacent the hoop portion.

11. A device for picking up objects from the ground as in claim 8 having, a pin attached to the squeeze grip, and an attachment to the horizontal handle portion having an aperture to engage the pin and lock the squeeze grip in a position adjacent the horizontal handle portion such that the sweep member is locked in a position adjacent the hoop portion.

12. A device for picking up objects from the ground as in claim 1 wherein, the vertical tube portion having an upper vertical tube portion and a lower vertical tube portion, the lower vertical tube portion rotatably attached to the upper vertical portion such that the hoop portion can be rotated with respect to the handle portion to face in a different direction for picking up objects to one side of the handle portion.

* * * * *